US005696352A

United States Patent [19]

Kourimsky

[11] Patent Number: 5,696,352

[45] Date of Patent: Dec. 9, 1997

[54] STRANDED ELECTRICAL WIRE FOR USE WITH IDC

[75] Inventor: Friedrich Josef Alois Kourimsky, Bensheim, Germany

[73] Assignee: The Whitaker Corporation, Wilmington, Del.

[21] Appl. No.: 503,465

[22] Filed: Jul. 18, 1995

[30] Foreign Application Priority Data

Aug. 12, 1994 [GB] United Kingdom ..... 9416331

[51] Int. Cl.[6] ..... H01B 5/00

[52] U.S. Cl. ..... 174/126.3; 174/128.1; 174/133 R

[58] Field of Search ..... 174/128.1, 126.3, 174/133 R, 113 AS

[56] References Cited

U.S. PATENT DOCUMENTS

| | | | |
|---|---|---|---|
| 2,050,298 | 8/1936 | Everett | 139/387 R |
| 2,804,494 | 8/1957 | Fenton | 174/113 AS |
| 3,131,469 | 5/1964 | Glaze | 228/136 |
| 3,234,722 | 2/1966 | Gilmore | 57/215 |
| 3,691,751 | 9/1972 | Hiller et al. | 57/145 |
| 3,760,093 | 9/1973 | Pemberon | 174/128 |
| 3,999,003 | 12/1976 | Chevrolet et al. | 174/113 AS |
| 4,538,023 | 8/1985 | Brisson | 174/113 AS |
| 4,550,559 | 11/1985 | Thomson | 57/223 |
| 4,936,647 | 6/1990 | Carroll | 174/128.1 |
| 5,022,867 | 6/1991 | Kourimsky et al. | 439/395 |
| 5,095,175 | 3/1992 | Yoshida et al. | 174/23 R |
| 5,133,121 | 7/1992 | Birbeck et al. | 29/872 |
| 5,216,205 | 6/1993 | Fuji et al. | 174/128.1 |
| 5,260,516 | 11/1993 | Blackmore | 174/113 A |

*Primary Examiner*—Kristine L. Kincaid
*Assistant Examiner*—Marc D. Machtinger

[57] ABSTRACT

A multi-stranded electrical conducting wire has conducting strands surrounded by an insulative jacket. The strands have serrations around the circumference thereof to inhibit slipping movement between adjacent strands. This is particularly advantageous when used with IDC contacts whereby the reduced slipping increases the contact pressure and therefore electrical conductivity of the connection, in particular for connections subject to vibration or thermal contraction and expansion movements.

5 Claims, 1 Drawing Sheet

STRANDED ELECTRICAL WIRE FOR USE WITH IDC

BACKGROUND OF THE INVENTION

1. Field of the Invention

This invention relates to stranded electrical wire for use with insulation displacing contacts (IDC) whereby the strands of the wire have peripheral serrations to reduce relative slipping movement between the strands thereby reducing the relaxation of the contact pressure between the wire and contact blades of an IDC when connected thereto.

2. Description of the Prior Art

Multi-stranded electrical wire is widespreadly used in the electrical industry, the wire commonly consisting of a plurality of cylindrical copper wire strands bundled and held together with an outer insulative jacket usually of some sort of plastic. The strands are not necessarily cylindrical depending on the requirements to have a more or less compact arrangement of the strands, an example of which is shown in U.S. Pat. No. 5,133,121. There are a number of commonly used techniques to connect electrical wire to a conductor, some of the most common being by crimping or by IDC technology. The use of IDC technology is ever-increasing as it is well adapted for cost-effective automated connection of conducting wires to electrical connectors. There are however a number of disadvantages of IDC technology with respect to crimping technology, one of the major factors being the reduced current carrying capability thereof. The latter is mainly due to the reduced contact area between the end area, in comparison to a crimped connection. IDC connections are typically made by forcing an insulated conducting wire between a pair of spaced apart and opposed metallic blades that cut through the insulation and enter into contact with some of the strands of the electrical wire. As the IDC blades only apply pressure to the wire on opposing sides thereof, the pressure will tend to deform the wire into an oval shape by pushing the strands of the wire towards the area of low pressure i.e. the slot openings. Deformation of the wire is however limited by the insulation jacket which nevertheless holds the strands bundled together. Further slipping of the strands between each other, during the lifetime of the connection, decreases the contact pressure between the strands and the IDC, and also between the strands themselves, this movement being generated by various factors such as vibration and thermal expansion and contraction.

In order to increase the contact pressure, and additionally to increase the reliable lifetime of the connector, it would be desirable to reduce slipping movement between adjacent strands of the wire.

SUMMARY OF THE INVENTION

It is therefore an object of this invention to provide a multi-stranded conducting wire for use with IDC technology, that has improved electrical connection characteristics with increased reliability.

It is a further object of this invention to provide a multi-stranded electrical wire that has reduced slipping between adjacent strands thereof.

It is a further object of this invention to provide a multi-stranded electrical wire that increases the lifetime and reliability of an electrical connection with an IDC, especially when subjected to mechanical and thermal solicitation.

The objects of this invention have been achieved by providing a stranded electrical wire comprising a plurality of longitudinal filiform conducting strands substantially held together, each strand comprising an outer surface in contact with adjacent strands, characterized in that the outer surface comprises radial serrations extending longitudinally along the strand to reduce slipping movement between adjacent strands in a direction substantially perpendicular to the longitudinal direction of the strands.

DETAILED DESCRIPTION OF THE PREFERRED EMBODIMENT

Figure 1:
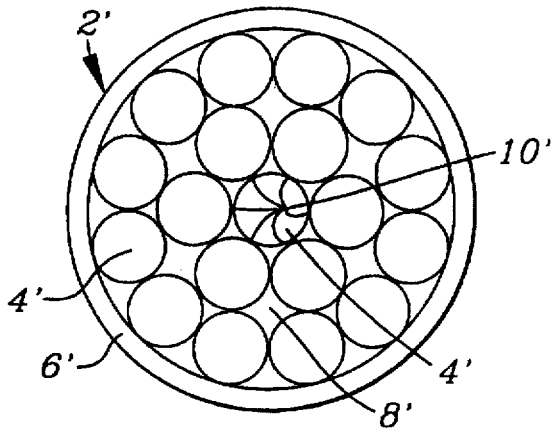
FIG. 1 (PRIOR ART)
FIG. 1 is a cross-sectional view of a prior art multi-stranded electrical wire.

Referring first to FIG. 1, a conventional multi-stranded conducting wire 2' comprises a plurality of filiform cylindrical conducting strands 4' bundled together and surrounded by an insulative outer jacket 6'. The strands 4' are typically made of a good conducting material such as copper. Each strand 4' has a smooth outer surface 8' which is in contact, at contact points 10', to adjacent strands.

Figure 2:
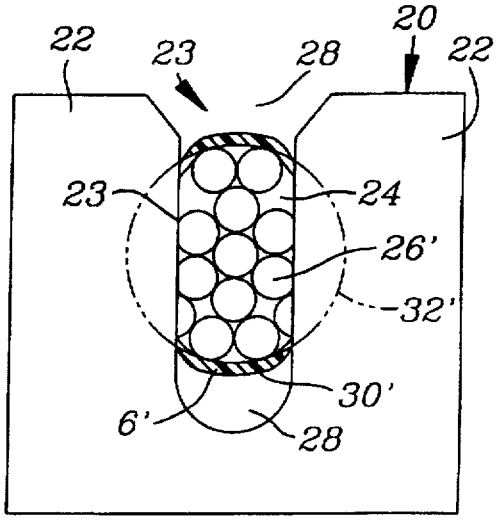
FIG. 2 (PRIOR ART)
FIG. 2 is a cross-sectional view through the wire of FIG. 1 inserted into an IDC slot.

Referring now to FIG. 2, an insulation displacing contact (IDC) 20 is shown comprising a pair of opposed blades 22 having blade contact edges 24 forming a wire receiving slot 23. The conducting wire 2' is shown stuffed between the blades 22, the blade edges 24 having cut through part of the insulating jacket 6' and making electrical contact with a few outer strands 26' of the wire 2'. The pressure of the blade edges 24 against the strands 26' causes the other strands 4' not in contact with the blade edges 24, to be pushed towards open ends 28 of the wire receiving slot 23 such that the cross-section of the wire 2', in the plane of the IDC blades 22, takes on a substantially oval shape 30'. The original circular profile of the wire 2' is shown by the phantom line 32'. The strands 4' are nevertheless held together by the outer insulation jacket 6'.

The movement of the strands 4' towards the slot openings 28 reduces the contact pressure between adjacent strands, and also the contact pressure between the strands 26' and blade contact edges 24. Further slipping movement between strands due to vibration, or thermal expansion and contraction cycles, will tend to move the strands such that pressure therebetween is reduced, thereby reducing the electrical conductivity therebetween. The electrical current carrying capability of the connection between the IDC 20 and wire 2' is thus reduced by mechanical and thermal solicitation, and therefore unreliable.

Figure 3:
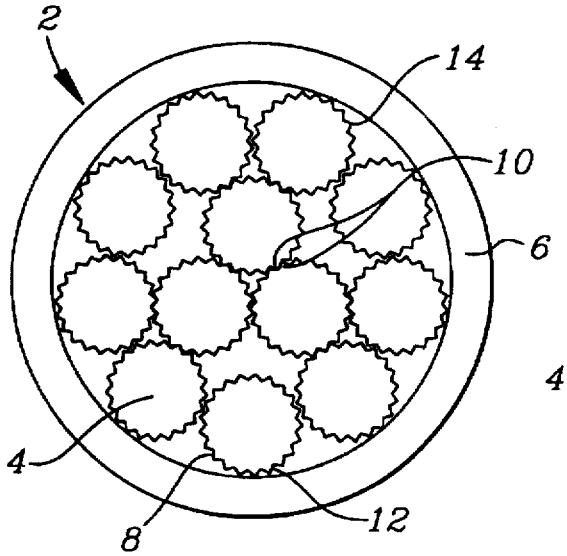
FIG. 3 is a cross-sectional view through a multi-stranded electrical wire according to the preferred embodiment of this invention.
Figure 4:
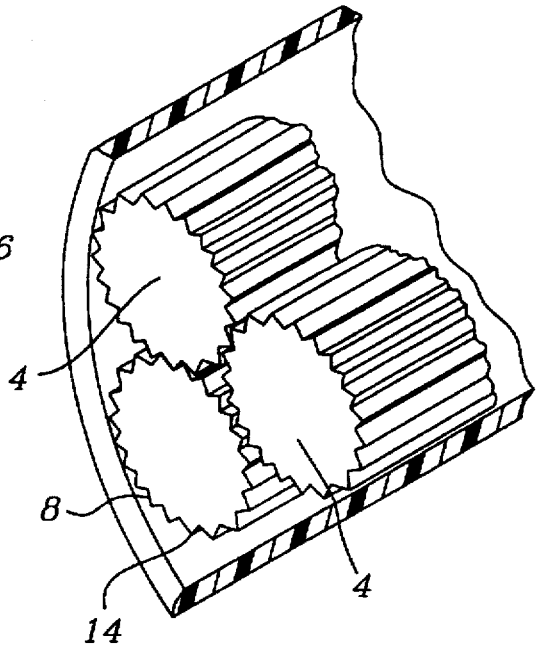
FIG. 4 is a partial isometric view of the wire shown in FIG. 3.

Referring now to FIGS. 3 and 4, the preferred embodiment of this invention is a multi-stranded electrical wire 2 comprising a plurality of conducting strands 4 bundled and held together by an outer insulative jacket 6. Each strand 4 has an outer surface 8 comprising serrations 12 having pointed tips 14 directed radially outwards, the serrations 12 disposed around the circumference of the strands 4 and extending longitudinally therealong. The pointed tips 14 of adjacent strands 4 interlock, and also provide electrical contact between strands at interlocking zones 10.

Interlocking of the serrations 12 inhibits slipping movement between adjacent strands 4 such that when the wire 2 is forced into an IDC slot 23, slipping of the strands relative to each other will be reduced thereby maintaining a higher contact pressure and thus a higher conductivity between the strands 4. The reliability and quality of the connection will also be increased during the lifetime thereof, especially when subjected to mechanical solicitation such as vibration or thermal movements due to expansion and contraction, by preventing slipping movement between the strands, which as already mentioned, could reduce the contact pressure and therefore the electrical conductivity between the wire and IDC.

Advantageously therefore, the serrated strands inhibit slipping therebetween, which is particularly important when the conducting wire is subject to vibration or thermal expansion and contraction, the contact pressure thereby maintained and increasing not only the electrical conductivity of the connection but also it's reliability.

I claim:

1. Stranded electrical wire for use with insulation displacing contacts, comprising a plurality of longitudinal filiform conducting strands substantially held together, each strand comprising an outer surface in contact with adjacent strands, characterized in that the outer surface comprises serrations extending longitudinally therealong to reduce slipping movement between the adjacent strands in a direction substantially perpendicular to the longitudinal direction of the strands.

2. The wire of claim 1 characterized in that the strands are substantially held together by an outer insulative jacket surrounding the plurality of strands.

3. The wire of claim 2 characterized in that the serrations have pointed tips directed substantially radially outwards, some of the pointed tips of adjacent strands interlocking with each other.

4. The wire of claim 3 characterized in that each strand comprises a large plurality of the serrations disposed around the whole circumference of the strand.

5. The wire of any preceding claim characterized in that the plurality of serrations are substantially identical in cross-sectional profile.

* * * * *